US009179208B2

(12) United States Patent
Hilderman et al.

(10) Patent No.: US 9,179,208 B2
(45) **Date of Patent: *Nov. 3, 2015**

(54) MICROPHONE STAND MOUNTING BRACKETS

(71) Applicant: The TC Group A/S, Risskov (DK)

(72) Inventors: David Hilderman, Victoria (CA); Calvin K. Ma, Toronto (CA); Damon Langlois, Victoria (CA)

(73) Assignee: The TC Group A/S, Risskov (DK)

( * ) Notice: Subject to any disclaimer, the term of this patent is extended or adjusted under 35 U.S.C. 154(b) by 360 days.

This patent is subject to a terminal disclaimer.

(21) Appl. No.: 13/899,822

(22) Filed: May 22, 2013

(65) Prior Publication Data

US 2014/0050344 A1 Feb. 20, 2014

Related U.S. Application Data

(60) Provisional application No. 61/683,123, filed on Aug. 14, 2012.

(51) Int. Cl.
*H04R 1/02* (2006.01)
*H04R 1/08* (2006.01)

(52) U.S. Cl.
CPC ..... *H04R 1/026* (2013.01); *H04R 1/025* (2013.01); *H04R 1/08* (2013.01); *Y10T 29/49947* (2015.01)

(58) Field of Classification Search
CPC ..... H04R 1/08; H04R 1/25; H04R 1/26; Y10T 29/29947; Y10T 29/49947
USPC ..... 381/87, 152, 362, 390, 361, 363, 366, 381/386, 332
See application file for complete search history.

(56) References Cited

U.S. PATENT DOCUMENTS

| | | | | |
|---|---|---|---|---|
| 2,216,886 | A | 7/1939 | Langelier | |
| 3,108,828 | A | 10/1963 | Kus | |
| 3,752,902 | A | 8/1973 | Wilson | |
| 6,125,188 | A | 9/2000 | Hennessy | |
| 6,487,298 | B1 | 11/2002 | Hacker | |
| 8,348,072 | B2 * | 1/2013 | Whitehall et al. | 211/196 |
| 2002/0066837 | A1 | 6/2002 | Dunbar | |
| 2003/0029975 | A1 * | 2/2003 | Cowan et al. | 248/220.1 |
| 2008/0253601 | A1 | 10/2008 | Hilderman | |
| 2009/0274330 | A1 | 11/2009 | Johnson | |
| 2010/0315479 | A1 * | 12/2010 | Wijngaarden et al. | 348/14.02 |

(Continued)

OTHER PUBLICATIONS

Jan. 16, 2014, International Search Report of the International Searching Authority from the U.S. Receiving Office, in PCT/US2013/054994, which shares the same priority as this U.S. application.

(Continued)

*Primary Examiner* — Vivian Chin
*Assistant Examiner* — William A Jerez Lora
(74) *Attorney, Agent, or Firm* — Kolisch Hartwell, P.C.

(57) ABSTRACT

A mounting bracket system for mounting a loudspeaker monitor onto a microphone stand pole without requiring disassembly of either the loudspeaker monitor or the microphone stand. First and second mounting brackets may be mounted to a loudspeaker monitor or other product to be mounted. An indent on each mounting bracket is configured to engage a microphone stand or another elongated, pole-like structure, supporting the weight of the loudspeaker monitor through frictional forces.

19 Claims, 7 Drawing Sheets

(56) References Cited

U.S. PATENT DOCUMENTS

2011/0253856 A1* 10/2011 Short ..... 248/222.14
2014/0050345 A1* 2/2014 Hilderman et al. ..... 381/332

OTHER PUBLICATIONS

Jan. 16, 2014, Written Opinion of the International Searching Authority from The U.S. Receiving Office, in PCT/US2013/054994, which shares the same priority as this U.S. application.

Oct. 25, 2013, Office action US Patent and Trademark Office, in U.S. Appl. No. 13/967,218, which shares the same priority as this U.S. application.

"SRM150 Compact Active PA System User's Manual", Feb. 2007, LOUD Technologies Inc., Woodinville, Washington.

"VoiceLive Touch Quick Start" manual, Oct. 2010, TC Helicon Vocal Technologies Ltd.

"VoiceSolo XT VSM-200 XT User Manual", Dec. 2010, TC Helicon Vocal Technologies Ltd., Risskov, Denmark.

* cited by examiner

MICROPHONE STAND MOUNTING BRACKETS

CROSS-REFERENCE TO RELATED APPLICATION

This application claims priority to U.S. Provisional Application Ser. No. 61/683,123, filed Aug. 14, 2012, which is hereby incorporated by reference into the present disclosure.

BACKGROUND

1. Loudspeaker monitors are speakers aimed at a musical performer so the performer can monitor his or her own singing or instrumental contribution during musical performances. Existing loudspeaker monitors are typically designed to be placed in front of the performer on the floor and aimed upwards so that the performer may adequately highlight his or her sound in relation to the surrounding music. As each performer in a group often will have a monitor, loudspeaker monitors are ubiquitous in musical performance environments. However, floor monitors may be difficult to hear because they are disposed relatively far from the singer. In addition, parameters such as volume and the like cannot easily be adjusted because a floor monitor is typically out of reach of the performer.

Microphone stands are pole-like structures designed to hold a microphone for a musical performer. Like monitors, they are also found in great numbers in musical performance environments. A singer or performer stands close to a microphone pole in order to approach the microphone that will project the performer's sound. It therefore would be desirous to attach the loudspeaker monitor to the microphone stand so that the performer could be closer to the loudspeaker to improve hearing and accessibility of controls.

Loudspeaker monitors have been made in the past that can mount onto standard microphone stands, allowing the user to be closer to the speakers. Examples include the TC-Helicon VSM series and the Mackie SRM 150 series loudspeaker monitors. However, to install these monitors onto a microphone stand generally requires the disassembly and reassembly of the microphone stand and the boom. Furthermore, loudspeaker monitors may require special adaptors that allow each part of the microphone stand to attach directly to the monitor. The disadvantages of such a system include the amount of time required to attach the loudspeaker, the cost of multiple adapters, and the fact that these adaptors can be easily lost or misplaced when they need to be removed or exchanged for another.

For the above reasons, it is desirable to develop a mounting bracket system that allows a performer to attach a loudspeaker monitor or other object to a microphone stand pole without requiring any tools or disassembly of the microphone stand.

DETAILED DESCRIPTION

The present teachings disclose a mounting bracket system, including apparatus and methods, for mounting a loudspeaker monitor onto a microphone stand without requiring disassembly of either the loudspeaker monitor or the microphone stand. The disclosed mounting bracket system comprises a set of mounting brackets attached or attachable to a loudspeaker. Each mounting bracket may include an indent adapted to fit on the loudspeaker and secure it to a microphone stand. The disclosed mounting bracket system reduces the amount of steps and time needed to set up a microphone stand-mounted loudspeaker monitor. In addition, the present teachings can be applied to mount other objects onto a microphone stand or another elongated, pole-like structure, without the use of generic fastener-style mounting attachments.

Figure 1:
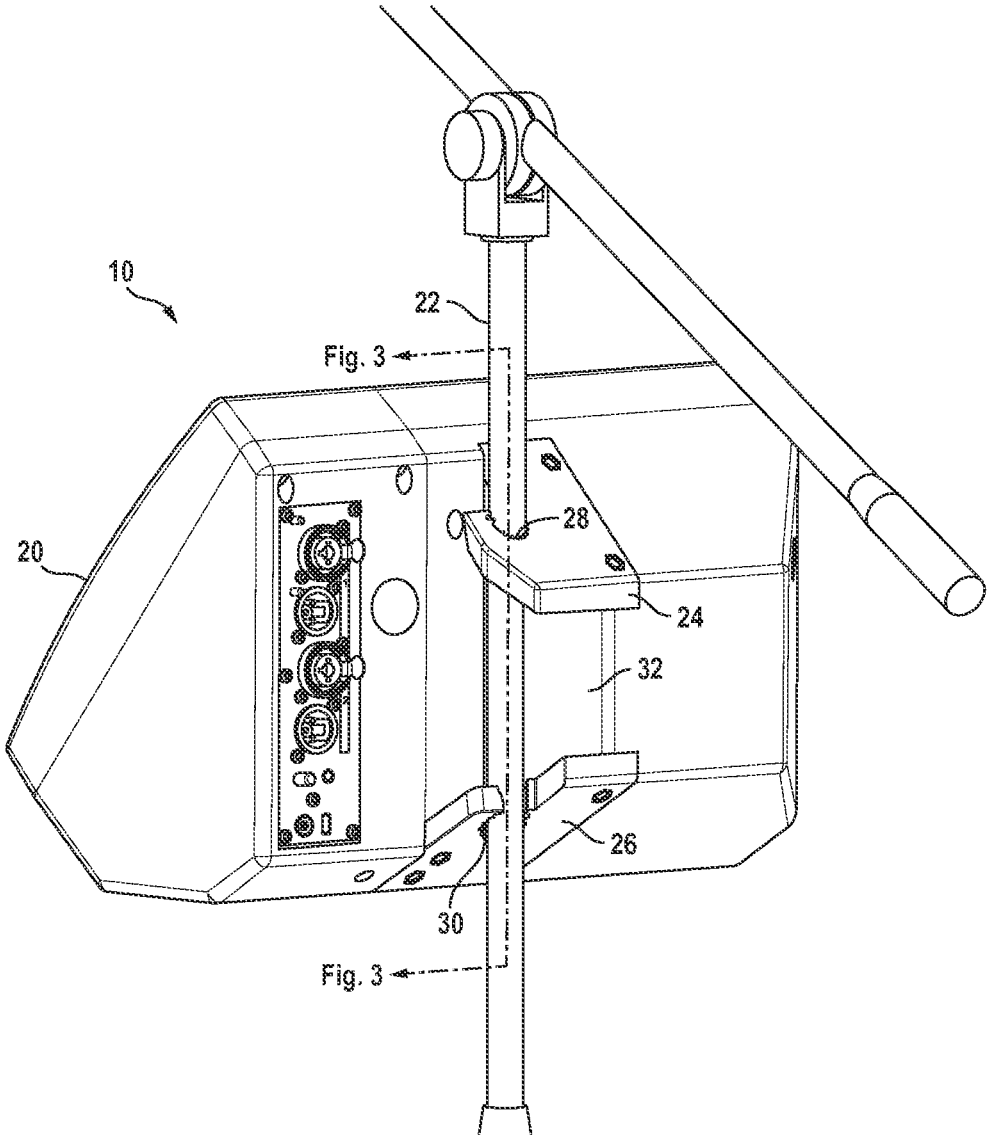
FIG. 1 is a perspective view of a loudspeaker monitor mounted on a microphone stand with mounting brackets, according to aspects of the present disclosure.

FIG. 1 is a perspective view depicting a first example of a loudspeaker monitor mounting bracket system according to the present teachings. The loudspeaker monitor mounting bracket system, generally indicated as 10, also may be referred to herein as a pole-mountable loudspeaker monitor system, or simply a mounting bracket system. In system 10, a loudspeaker monitor 20 is secured to a microphone stand pole 22 by way of a first mounting bracket 24 and a second mounting bracket 26. A first indent 28 is formed in the first mounting bracket 24 and faces generally toward the back surface or back side 32 of the loudspeaker monitor 20 when the first mounting bracket is attached to the monitor. A second indent 30 is formed in the second mounting bracket 26 and faces generally away from the back side 32 of the loudspeaker monitor 20 when the second mounting bracket is attached to the monitor.

As depicted in FIG. 1, first indent 28 and second indent 30 are substantially U-shaped. Furthermore, each indent is serrated, i.e. each indent includes a surface with tooth-like notches adapted to grip the microphone stand pole 20 when the pole is placed within the indent. However, the indents may include an alternate structure for increased gripping. One such structure may be a narrowing protrusion at the open end of the indent to restrict the movement of the microphone stand pole 22. To provide further gripping ability, the indents may be coated with a high-friction material, one example of which may be rubber. The indents may also take any other form allowing each to face generally in the specified direction and, in particular, may be shaped to increase an area of contact between the indent and the microphone stand pole. In general, indents 28 and 30 are provided with a design (i.e., constructed from a material and with an inner surface area and geometry) sufficient to support a loudspeaker monitor on a microphone stand pole through frictional forces between the indents and the pole.

Figure 2:
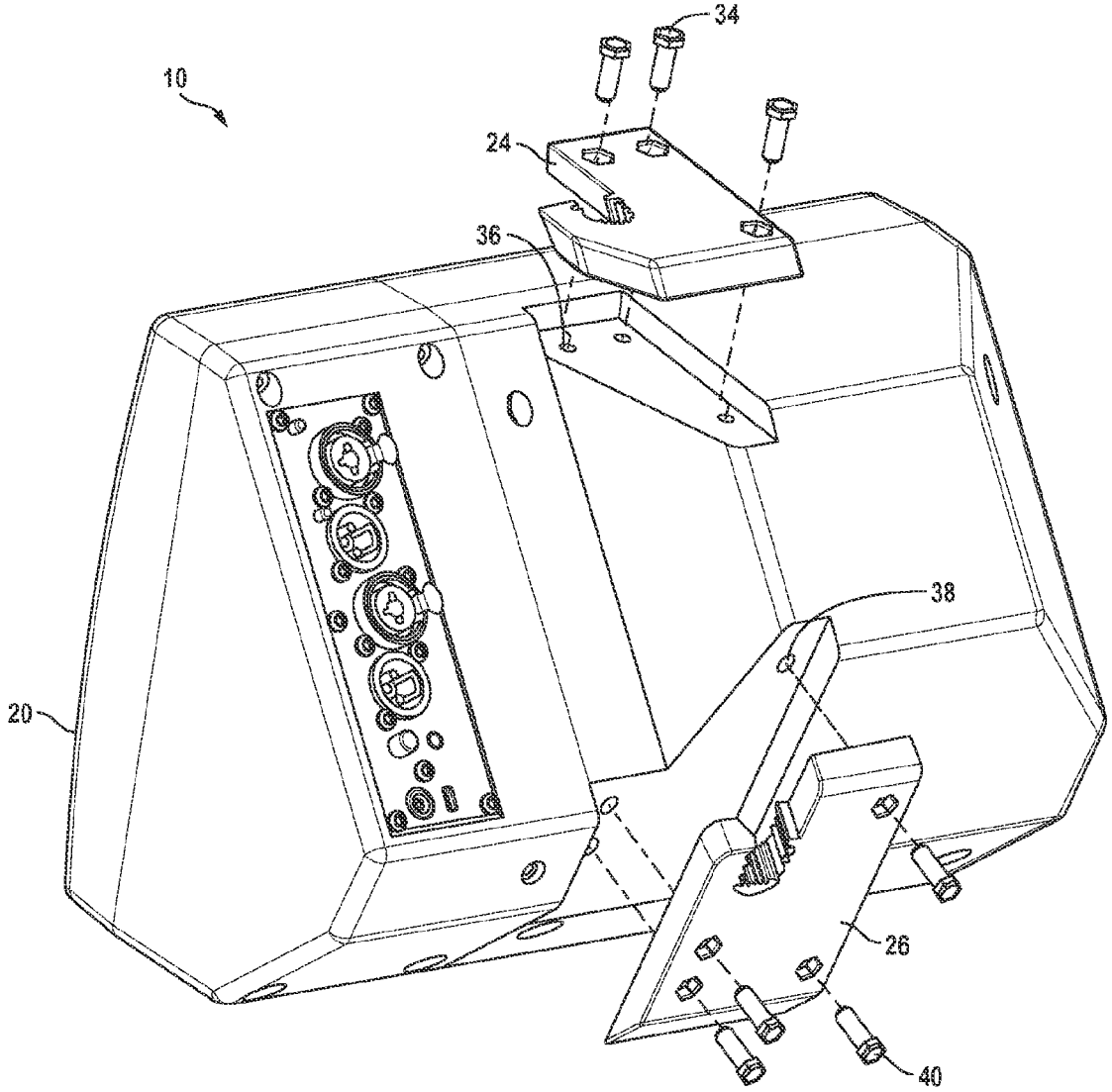
FIG. 2 is an exploded isometric view of the microphone stand mounting bracket system of FIG. 1.

FIG. 2 is an exploded isometric view depicting how microphone stand mounting system 10 may be assembled according to aspects of the present teachings. In the depicted embodiment, the first mounting bracket 24 is attached to the loudspeaker monitor 20 using a first set of screw or bolt-style fasteners comprising at least one fastener 34. Each fastener 34 connects to an attachment point 36 that is part of a first set of attachment points on the body of the loudspeaker monitor 20. Similarly, the second mounting bracket 26 is fastened to the loudspeaker monitor 20 using a second set of screw or bolt-style fasteners comprising at least one fastener 40. Each fastener 40 connects to an attachment point 38, part of a second set of attachment points on the body of the loudspeaker monitor 20.

In the depicted example, the locations of the attachment points on the body of the loudspeaker monitor 20 are configured such that the first and second mounting brackets 24 and 26 are angled toward each other as they extend away from the back surface 32 of the loudspeaker monitor 20. However, the attachment points and corresponding brackets may be configured to extend outward at any desired angle and location to achieve the desired grip on a microphone stand pole (or other similar object) through frictional forces.

As is also depicted in FIGS. 1-2, the first mounting bracket 24 is configured to be attached to a top portion of the loudspeaker monitor 20, and the second mounting bracket 26 is configured to be attached to a bottom portion of the loudspeaker monitor 20. Thus, the first mounting bracket 24 attaches above the second mounting bracket 26. However, the mounting brackets may be configured to attach to the monitor in any configuration such that they extend away from the back surface 32 to the desired location of engagement with the microphone stand pole.

Figure 3:
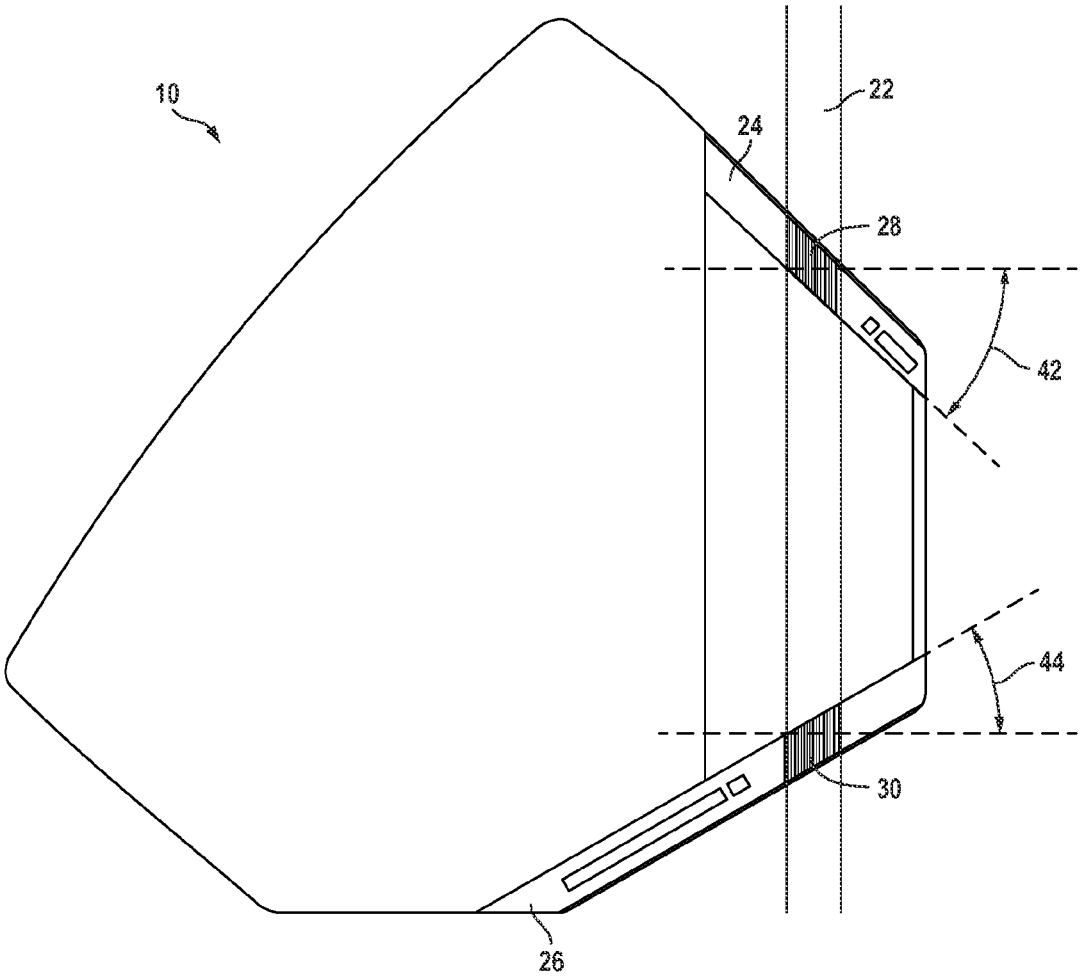
FIG. 3 is a schematic side sectional view of a loudspeaker monitor mounted on a microphone.

FIG. 3 depicts a schematic side sectional view of mounting bracket system 10, where the view is sectioned at microphone stand pole 22, but without showing any of the irrelevant internal structure of the loudspeaker monitor. The upper angle 42 at which the first mounting bracket 24 is oriented relative to an axis perpendicular to the microphone stand, and the lower angle 44 at which the second mounting bracket 26 is oriented relative to an axis perpendicular to the microphone stand, can be adjusted to accommodate different housing sizes and geometries of the object to be mounted. However, the angle of the tooth-like notches of the first indent 28 and second indent 30, when serrated as depicted, may be configured to remain parallel to the microphone stand pole 22 to retain maximum surface area contact with the pole and thus provide the best gripping force.

Loudspeaker monitor 20 stays in place through frictional forces provided by the indents, which in turn depend upon the coefficient of friction between the indents and the microphone stand pole, and the normal forces exerted against the pole by the two mounting brackets. First mounting bracket 24 exerts a normal force upon microphone stand pole 22 toward loudspeaker monitor 20, and second mounting bracket 26 exerts a normal force upon microphone stand pole 22 away from loudspeaker monitor 20, so that the normal forces balance each other. Additionally, when the loudspeaker monitor is in static equilibrium, the frictional forces provided by the indents collectively balance the weight of loudspeaker monitor 20 such that it stays in place.

Figure 4:
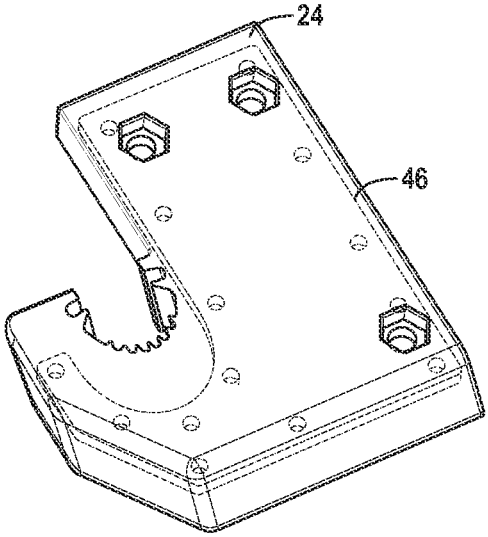
FIG. 4 is an isometric view of an exemplary first mounting bracket according to aspects of the present disclosure.
Figure 5:
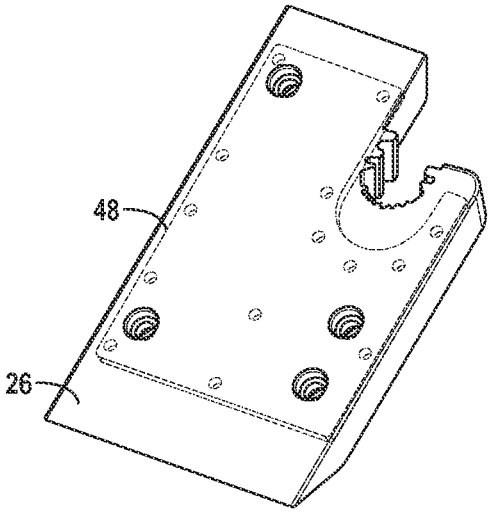
FIG. 5 is an isometric view of an exemplary second mounting bracket according to aspects of the present disclosure.

As depicted in FIG. 4, first mounting bracket 24 may include a first base plate 46 (shown in dashed lines) contained within the bracket. Similarly, second mounting bracket 26 may include a second base plate 48 contained within the bracket, as depicted in FIG. 5. Each base plate may be designed and constructed to strengthen the corresponding bracket and provide the rigidity necessary to support the object being mounted. The base plate may be made of any material suitable for forming a bracket with the desired physical attributes, and in some cases may be constructed of a metal, injection molded plastic, or other similarly rigid material. The corresponding mounting bracket may be constructed by attaching an over-moulding to the base plate, as depicted in FIGS. 4 and 5, and such over-moulding may use a high-friction material, such as rubber, for gripping the pole.

Figure 6:
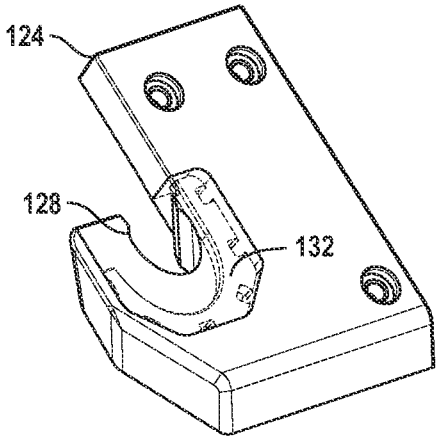
FIG. 6 is an isometric view of another exemplary first mounting bracket according to aspects of the present disclosure.
Figure 7:
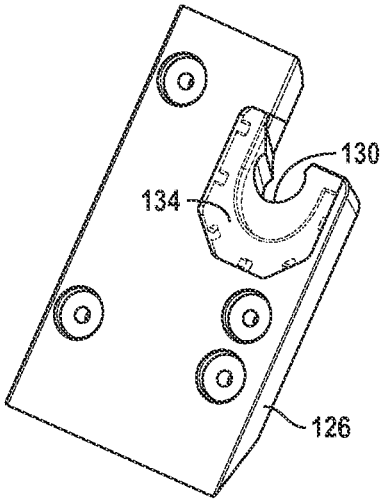
FIG. 7 is an isometric view of another exemplary second mounting bracket according to aspects of the present disclosure.

FIGS. 6 and 7 depict another illustrative example of mounting brackets that may be used in loudspeaker monitor mounting bracket systems such as system 10, according to aspects of the present teachings. Referring to FIG. 6, a first mounting bracket 124 includes a first indent 128. Rather than including a base plate, a first indent frame 132 is formed as part of the first mounting bracket 124, and the indent frame is covered by a high-friction material, such as rubber, to form indent 128. Similarly, FIG. 7 shows a second mounting bracket 126, which includes a second indent 130. A second indent frame 134 is formed as part of the second mounting bracket 126 and is covered by a high friction material to form indent 130.

The mounting brackets and indent frames of the example depicted in FIGS. 6-7 may be a single part that may be molded from a material such as plastic. For example, brackets 124 and 126 may be constructed by injection molding of a thermoplastic material. In addition, the first and second indent frames 132 and 134 may be integrally formed as a part of each single part bracket. The indent frames then may be coated with a high-friction material, one example of which may be rubber, to form indents 128, 130 with strong gripping ability.

As depicted in FIGS. 6-7, the indents also may include a gripping structure formed by a narrowing protrusion at the open end of the indent, to restrict the movement of the microphone stand pole within the indent. In the embodiment of FIGS. 6-7, these narrowing protrusions are formed in the rubber portions of the brackets that are attached to the indent frames to form the indents. In other cases, the indents may include an alternate structure for increased gripping, such as serrated indents, or in some cases may be entirely u-shaped with no specific additional gripping structure. In any case, the indents should provide sufficient friction to engage a microphone stand pole securely, due to factors such as the coefficient of friction and surface area of each indent, in combination with the angles of contact of the indents with the pole.

Figure 8:
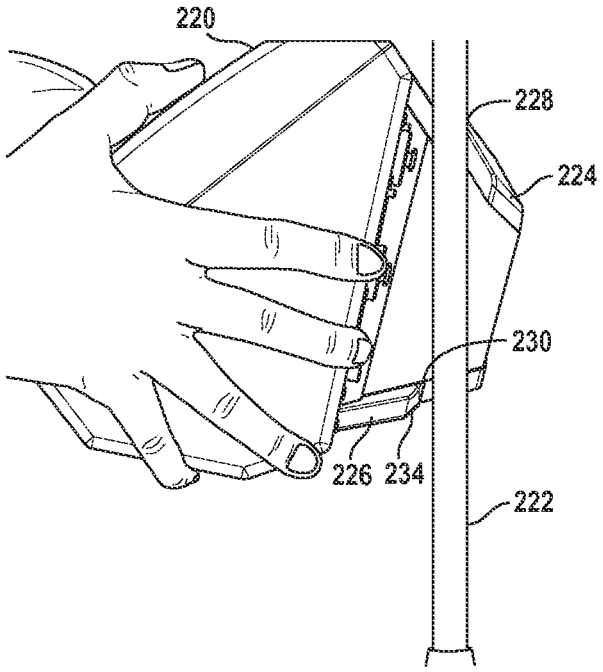
FIGS. 8 and 9 are side elevational views depicting installation of a loud speaker monitor onto a microphone stand pole.
Figure 9:
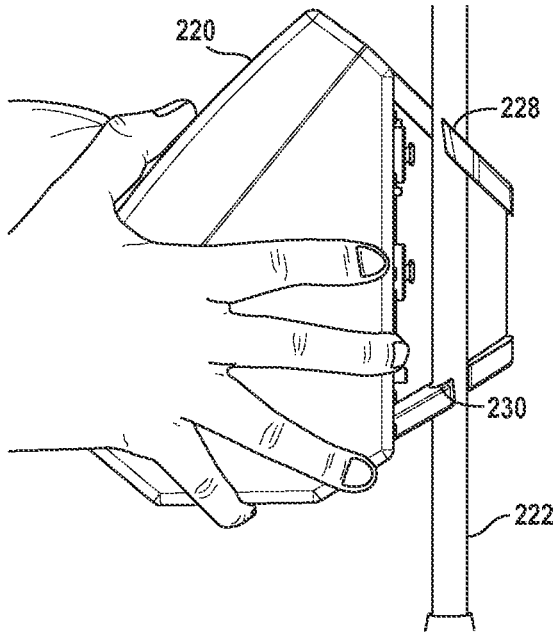

FIGS. 8 and 9 depict steps that may be performed to install a pole-mountable loudspeaker monitor system, according to aspects of the present teachings. To install a loudspeaker monitor 220 onto a microphone stand pole 222 using an exemplary mounting bracket system such as those described above, a user positions loudspeaker monitor 220 with microphone stand pole 222 aligned with the gap between first mounting bracket 224 and back side 232 of loudspeaker monitor 220, and rotates monitor 220 so that microphone stand pole 222 is distal to an inner edge 234 of second mounting bracket 226. The user then moves the loudspeaker monitor laterally until pole 222 is laterally aligned with indents 228 and 230. As depicted in FIG. 9, the user then rotates the loudspeaker so that the first indent 228 and second indent 230 each slide into engagement with the microphone stand pole 222.

Figure 10:
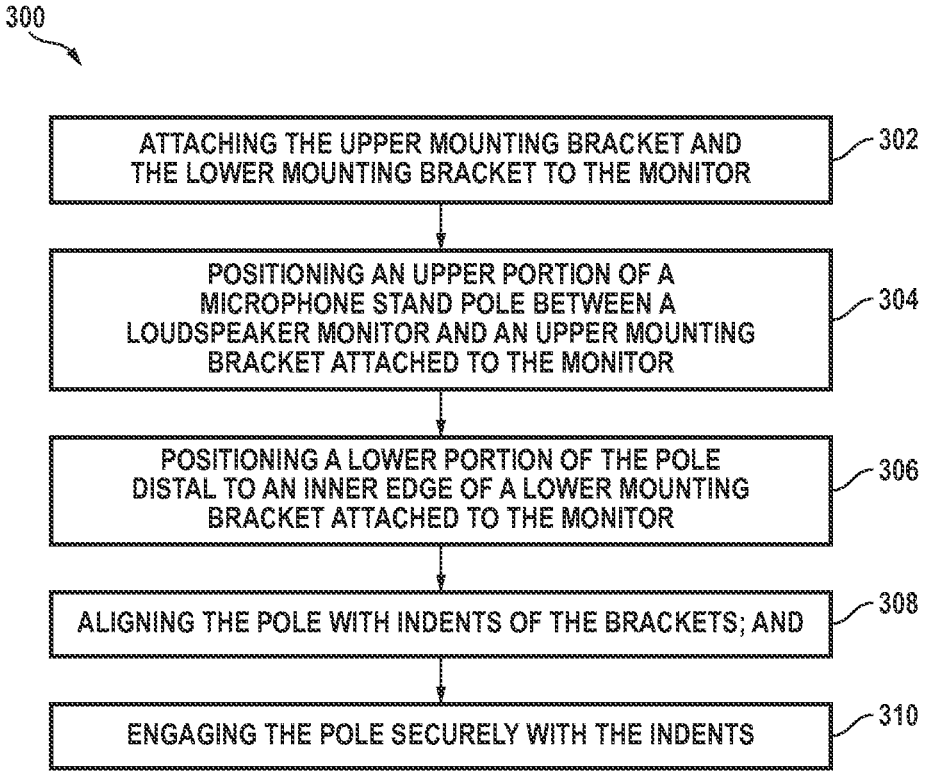
FIG. 10 is a flowchart depicting a method of installing a loudspeaker monitor onto a microphone stand pole using mounting brackets, according to aspects of the present teachings.

FIG. 10 depicts a method, generally indicated at 300, of mounting a loudspeaker monitor to a microphone stand, according to aspects of the present teachings. Method 300 may be generally suitable for use with various mounting bracket systems described according to the present teachings, including the systems shown and described above.

At step 302, an upper mounting bracket is attached to a corresponding location on the monitor and a lower mounting bracket is similarly attached to its corresponding location on the monitor. At step 304, an upper portion of a microphone stand pole is positioned between the loudspeaker monitor and the upper mounting bracket attached to the monitor. At step 306, a lower portion of the pole is positioned distal to an inner edge of the lower mounting bracket attached to the monitor. At step 308, the pole is aligned with indents of the first and second mounting brackets. And at step 310, the pole is securely engaged with each indent.

According to the present teachings, all of the steps of method 300 may be performed without any disassembly of the microphone stand. Furthermore, the mounting brackets used in conjunction with method 300 may include any of the properties previously described with respect to the exemplary embodiments, such as indents that are substantially u-shaped, coated with rubber or some other relatively high-friction material, and/or serrated, among others.

There are ways in which a microphone stand mounting bracket system according to the present teachings can be used in other applications. Instead of a loudspeaker monitor, it is also possible to install the brackets onto different products that can benefit from being mounted onto a microphone stand. For example, it may be desirable to attach laptop trays, musical mixers, utility trays, etc. to a microphone stand pole. The present teachings are not limited to mounting loudspeaker monitors.

Similarly, the present teachings are not limited to mounting objects onto microphone stand poles. A bracket system according to the present teachings can be implemented to mount arbitrary objects onto any pole-like structure with an arbitrary diameter, by changing parameters such as the sizes and angles of the mounting brackets, the size of the indent teeth on the mounting brackets, and/or the materials used to construct the mounting brackets. For example, it may be desirable to mount spotlights, fans, computer screens, etc. onto poles on a stage or otherwise at a performance venue. The present teachings generally contemplate mounting any objects associated with musical performances onto stands or poles of arbitrary diameter, in a convenient and tool-free manner.

What is claimed is:

1. A loudspeaker monitor mounting bracket system, comprising:

first and second mounting brackets each configured to be attached to a loudspeaker monitor and to extend generally away from a back side of the monitor;

a first indent formed in the first mounting bracket and facing generally toward the back side of the monitor when the first mounting bracket is attached to the monitor; and a second indent formed in the second mounting bracket and facing generally away from the back side of the monitor when the second mounting bracket is attached to the monitor;

wherein the mounting brackets are angled toward each other as they extend away from the back side of the monitor; and wherein each indent is configured to engage a microphone stand without requiring any disassembly of the stand.

2. The system of claim 1, wherein the first mounting bracket is configured to be attached to the loudspeaker monitor above the second mounting bracket.

3. The system of claim 1, wherein each indent is substantially u-shaped.

4. The system of claim 1, wherein at least one of the indents is serrated.

5. The system of claim 1, wherein at least one of the indents is constructed from a high-friction material.

6. The system of claim 5, wherein the high-friction material is rubber.

7. The system of claim 1, wherein each mounting bracket includes a base plate and an over-moulding attached to the base plate.

8. A pole-mountable loudspeaker monitor system, comprising:

a loudspeaker monitor;

a first mounting bracket attached to the loudspeaker monitor and including a first indent facing generally toward a back surface of the loudspeaker monitor;

a second mounting bracket attached to the loudspeaker monitor and including a second indent facing generally away from the back surface of the loudspeaker monitor;

wherein the mounting brackets are angled toward each other as they extend away from the back side of the monitor; and wherein the indents are configured to engage a microphone stand pole and to hold the loudspeaker monitor securely in place on the pole without any disassembly of the stand.

9. The system of claim 8, wherein the first mounting bracket is configured to be attached to a top portion of the monitor, and the second mounting bracket is configured to be attached to a bottom portion of the monitor.

10. The system of claim 8, wherein each indent is substantially u-shaped.

11. The system of claim 8, wherein each indent is shaped to increase an area of contact between the indent and the microphone stand pole.

12. The system of claim 8, wherein each indent is serrated.

13. The system of claim 8, wherein at least one of the indents is formed by a high-friction material applied to an underlying indent frame.

14. The system of claim 13, wherein the high-friction material is rubber.

15. A method of mounting a loudspeaker monitor to a microphone stand, comprising:

positioning an upper portion of a microphone stand pole between a loudspeaker monitor and an upper mounting bracket attached to the monitor;

positioning a lower portion of the pole distal to an inner edge of a lower mounting bracket attached to the monitor;

aligning the pole with indents of the brackets; and engaging the pole securely with the indents;

wherein the mounting brackets are angled toward each other as they extend away from the back side of the monitor; and wherein the method is performed without any disassembly of the microphone stand.

16. The method of claim 15, further comprising attaching the upper mounting bracket and the lower mounting bracket to the monitor.

17. The method of claim 15, wherein each indent is substantially u-shaped.

18. The method of claim 17, wherein each indent is coated with rubber.

19. The method of claim 17, wherein each indent is serrated.

* * * * *